United States Patent [19]

MacFee

[11] 4,091,509

[45] May 30, 1978

[54] SLIDE FASTENER WITH BOTTOM STOP

[75] Inventor: Norman W. MacFee, Conneaut Lake, Pa.

[73] Assignee: Textron Inc., Providence, R.I.

[21] Appl. No.: 752,825

[22] Filed: Dec. 20, 1976

[51] Int. Cl.[2] ..... A44B 19/36
[52] U.S. Cl. ..... 24/205.11 R
[58] Field of Search ..... 24/205.11 R

[56] References Cited

U.S. PATENT DOCUMENTS

| | | | |
|---|---|---|---|
| 2,347,426 | 4/1944 | Marinsky | 24/205.11 R |
| 2,398,592 | 4/1946 | Morin | 24/205.11 R |

*Primary Examiner*—Bernard A. Gelak
*Attorney, Agent, or Firm*—O'Brien & Marks

[57] ABSTRACT

An elongated member inserted through coinciding central openings of interlocking coils at the bottom of a slide fastener is secured therein by deforming one or more of the convolutions of the coils at the bottom of the slide fastener.

5 Claims, 6 Drawing Figures

FIG.4
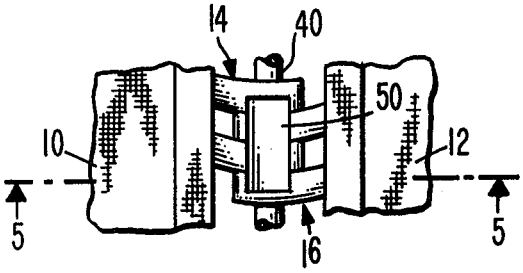
FIG. 5
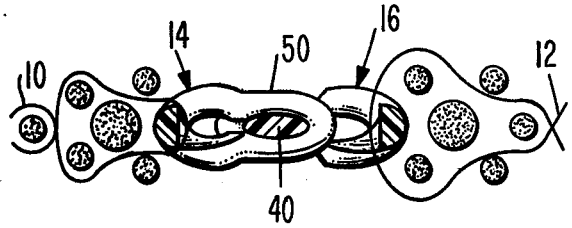
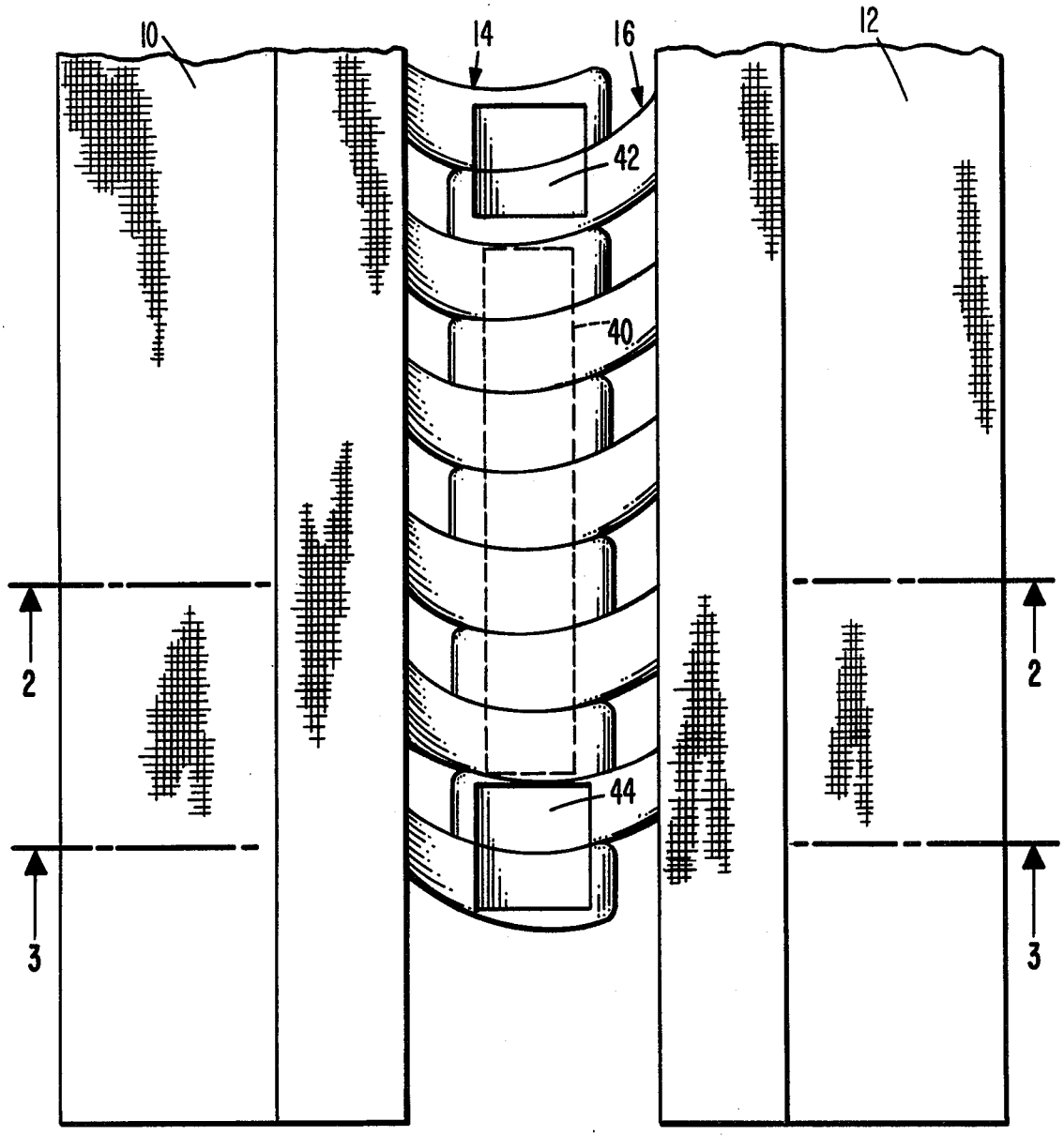
FIG. 6

SLIDE FASTENER WITH BOTTOM STOP

BACKGROUND OF THE INVENTION

1. Field of the Invention

This invention relates to a slide fasteners and particularly to bottom stops for slide fasteners.

2. Description of the Prior Art

The prior art contains a number of bottom stops for slide fasteners as well as methods of making the same. U.S. Pat. No. 2,398,592 discloses a bottom stop formed by a headed pin inserted through coinciding apertures of interlocking scoops wherein the non-headed end of the pin in flattened or enlarged to secure the pin; such headed pin and flattening or enlargment of the opposite end to secure the pin is difficult to install in meshing coil or spiral coupling elements. U.S. Pat. Nos. 2,220,136, 3,263,291 and 3,639,969 discloses bottom stops formed by cementing or fusing a number of interlocking links or coil loops together such as by a solvent or ultrasonic energy, while U.S. Pat. Nos. 3,190,779 and 3,857,141 disclose bottom stops formed by fusing thermoplastic blocks or strips over interlocking coil elements; such fused bottom stops are generally subject to one or more deficiencies such as being inadequately fused, resulting in undesirable protuberances, distortion of the slide fastener, etc.

SUMMARY OF THE INVENTION

The invention is summarized in a slide fastener with a bottom stop including a pair of carrier tapes, a pair of elongated coupling members attached to the inner edges of the respective carrier tapes, a slider movably mounted on the coupling members, each of the coupling members being a coil formed from a continuous filament and having successive convolutions with head portions for meshing and interlocking with the convolutions of the opposite coupling member, said coils having bottom segments meshed together, each of the coils formed with a central opening extending longitudinally therethrough and which partially coincides with the central opening of the opposite coil at the meshed segments of the coils, an elongated member extending in the coinciding portions of the central openings in the bottom segments of the coils to prevent the bottom segments from being separated, and at least one convolution of the coils at the bottom segments being deformed into the central opening to secure the elongated member in the bottom segments.

An object of the invention is to construct a slide fastener with a bottom stop which is relatively strong and inexpensive to manufacture.

Another object of the invention is to provide a strong bottom stop on a slide fastener which does not result in protuberances.

It is also an object of the invention to form a bottom stop on a slide fastener without significantly deforming the slide fastener or interfering with the flexibility of the slide fastener.

One advantage of the invention is that an elongated member secured in aligned openings of meshed interlocking coils at the bottom of the slide fastener by staking or deforming the coil permits the formation of a strong, reliable bottom stop with less expense.

A feature of the invention is to deform the coil just above and below an elongated member inserted in the meshing coils to thus avoid weakening of the elongated member.

Other objects, advantages and features of the invention will be apparent from the following description of the preferred embodiment taken in conjunction with the accompanying drawings.

BRIEF DESCRIPTION OF THE DRAWINGS

FIG. 4 is a plan view of a broken away bottom portion of a slide fastener with a modified bottom stop.

FIG. 5 is a cross section view of the modified slide fastener taken at line 5—5 of FIG. 4.

FIG. 6 is an enlarged plan view of a broken away bottom portion of the slide fastener of FIG. 1.

DESCRIPTION OF THE PREFERRED EMBODIMENT

Figure 1:
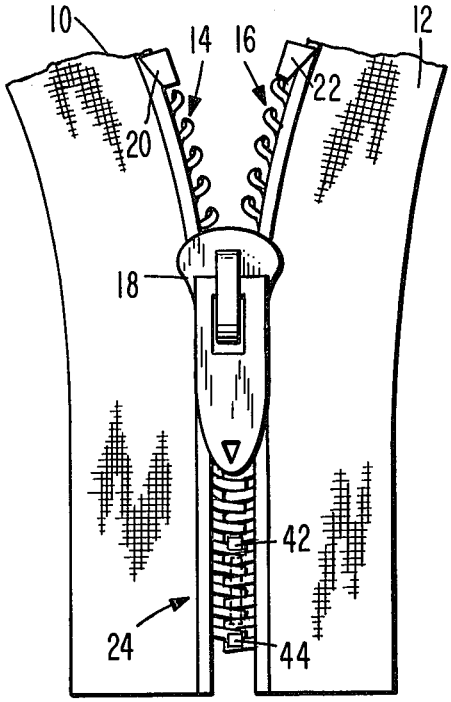
FIG. 1 is a plan view of a slide fastener constructed in accordance with the invention.

As illustrated in FIG. 1, a slide fastener manufactured in accordance with the invention includes a pair of planarly arranged tapes 10 and 12 with respective coupling members indicated generally at 14 and 16 attached to the inner edges of the respective tapes 10 and 12 and with a slider 18 movably mounted on the coupling members 14 and 16 for opening and closing the slide fastener. Conventional top stops, such as mold masses of thermoplastic material 20 and 22, are attached to the upper ends of the coupling members 14 and 16 and the tapes 10 and 12. The tape 10 and coupling member 16 form a right stringer for the slide fastener; the right and left stringers form a slide fastener chain when they are coupled together. A bottom stop indicated generally at 24 is formed at the bottom of the slide fastener for holding the stringers together and to limit downward movement of the slider 18.

Figure 2:
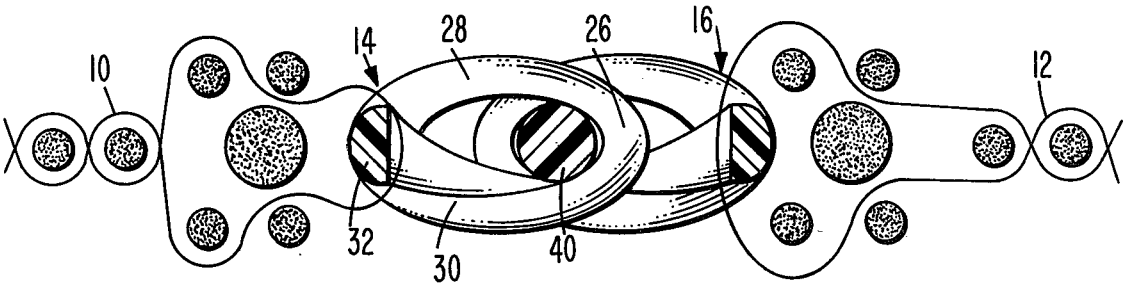
FIG. 2 is an enlarged cross section view of a portion of the slide fastener taken at lines 2—2 in FIG. 6.

As shown in FIGS. 2 and 6, the coupling members 14 and 16 are coils or spirals formed from respective continuous filaments of a thermoplastic material. The illustrated coils are formed from filaments with oblong cross sections which are twisted so as to form head portions 26, upper leg portions 28, lower leg portions 30 and heel portions 32 interconnecting adjacent convolutions of the coil; alternately the coils can be formed from a filament of round cross section and the head portions can be formed by deforming the cross section of the filament. The coils 14 and 16 have central openings therein, and when meshed as illustrated in FIGS. 2 and 6, portions of the central openings of the respective coils 14 and 16 coincide or are aligned in a longitudinal direction relative to the slide fastener.

Figure 3:
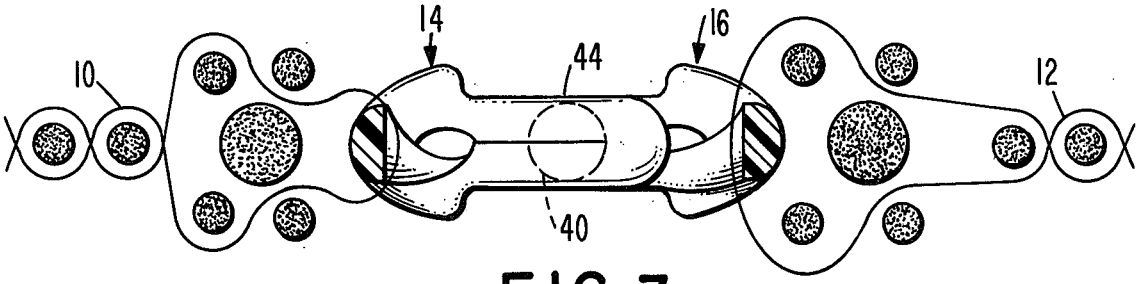
FIG. 3 is an enlarged cross section view of a portion of the slider fastener taken at line 3—3 of FIG. 6.

The bottom stop 24 is formed as illustrated in FIGS. 2, 3 and 6 from a elongated member 40 inserted into the coinciding portions of the central openings of meshing segments of the coils 14 and 16 at the bottom of the slide fastener. The elongated member 40 has a length to extend through a plurality of convolutions of both coils 14 and 16 and is secured in the bottom portion of the slide fastener by deforming or flattening one or more of the convolutions of the coils 14 and 16 into the coinciding portions of the openings such as at points 42 and 44 just above and below, respectively, the elongated member 40.

The convolutions of the coils 14 and 16 can be deformed by staking with an ultrasonic vibrating tool. The member 40 is formed from a relatively rigid material such as the materials conventionally used in the filaments forming the coils 14 and 16.

In operation of the slide fastener, the elongated member 40 prevents the coils 14 and 16 from being separated by the slider 18 at the bottom of the slide fastener. Further the slider will be prevented from the sliding off of the bottom of the slide fastener due to the engagement of the divider post (not shown) in the slider 18 with the convolutions of the coils 14 and 16 which are held together at the bottom of the slide fastener.

Having the elongated member inserted through the coinciding portions of a plurality of convolutions of each of the coils 14 and 16 results is a substantially more reliable and stronger bottom stop when compared to bottom stops formed by fusing the coils together or fusing blocks of thermoplastic thereon. Weak bottom stops are formed when there is insufficient fusion of the coils or blocks of thermoplastic which results from normal variations in manufacturing equipment and procedures. Further the strength of the filamentary material of the coils can be degraded by excessive heating and reforming. In contrast, the strength of the elongated member 40 is much less subject to variation and the deformation of the coils, such as at 42 and 44, necessary to secure the member 40 is insufficient to cause any substantial degradation of strength of the coiled filamentary material at the bottom stop.

It is noted that the bottom stop 24 does not have any protuberances such as those formed by conventional staples or fused blocks of thermoplastic, and that bottom stop 24 is formed in only two relatively easy steps, namely: insertion of the elongated member in the coinciding portions of the central openings of the coils, and staking the coils to secure the elongated member therein.

In a modification shown in FIGS. 4 and 5 the coils 14 and 16 are staked or deformed at 50 over the elongated member 40 so as to partially deform the member 40 and interlock therewith instead of being deformed above and below the member 40.

In the modification of FIGS. 4 and 5, the member 40 may be weakened slightly compared to that of FIGS. 1–3 and 6; however a suitable bottom stop can still be made with a proper selection of material and control of the deforming step.

Since the present invention is subject to many modifications, variations, and changes in detail it is intended that all matter in the foregoing description or shown in the accompanying drawings be interpreted as illustrative and not in a limiting sense.

What is claimed is:

1. A slide fastener with a bottom stop comprising
a pair of carrier tapes,
a pair of elongated coupling members attached to the inner edges of the respective carrier tapes,
a slider movably mounted on the coupling members,
each of the coupling members being a coil formed from a continuous filament and having successive convolutions with head portions for meshing and interlocking with the convolutions of the opposite coupling member,
said coils having bottom segments meshed together,
each of the coils formed with a central opening extending longitudinally therethrough and which partially coincides with the central opening of the opposite coil at the meshed bottom segments of the coils,
an elongated member extending in the coinciding portions of the central openings in the bottom segments of the coils to prevent the bottom segments from being separated, and
at least one convolution of the coils at the bottom segments being deformed into the central opening to secure the elongated member in the bottom segments.

2. A slide fastener with a bottom stop as claimed in claim 1 wherein at least one convolution above the elongated member and one convolution below the elongated member are deformed into the central opening to secure the elongated member in the bottom portion of the slide fastener.

3. A slide fastener with a bottom stop as claimed in claim 1 wherein the one convolution of the coil which is deformed into the central portion is over the elongated member, and the elongated member is deformed to interlock therewith.

4. A slide fastener with a bottom stop as claimed in claim 1 wherein the elongated member extends through a plurality of convolutions of each of the coupling members.

5. A slide fastener with a bottom stop as claimed in claim 1 wherein the elongated member extends through a plurality of convolutions of each of the coils, and at least one convolution of the coils above the elongated member is deformed, and at least one convolution of the coil below the elongated member is deformed to secure the elongated member in the coils.

* * * * *